US008915003B2

(12) United States Patent
Heizer et al.

(10) Patent No.: US 8,915,003 B2
(45) Date of Patent: Dec. 23, 2014

(54) AMMUNITION COMPARTMENT WITH STRIP CLIP

(76) Inventors: Charles K. Heizer, St. Louis, MO (US); Raymond B. Kohout, Lake Ozark, MO (US)

( * ) Notice: Subject to any disclaimer, the term of this patent is extended or adjusted under 35 U.S.C. 154(b) by 0 days.

(21) Appl. No.: 13/620,800

(22) Filed: Sep. 15, 2012
(Under 37 CFR 1.47)

(65) Prior Publication Data

US 2013/0199070 A1 Aug. 8, 2013

Related U.S. Application Data

(60) Provisional application No. 61/535,315, filed on Sep. 15, 2011.

(51) Int. Cl.
*F41A 9/61* (2006.01)
*F41C 23/22* (2006.01)
*F41A 9/84* (2006.01)

(52) U.S. Cl.
CPC .. *F41A 9/84* (2013.01); *F41C 23/22* (2013.01)
USPC ..... 42/49.01; 42/11; 42/17; 42/24; 42/29; 42/33; 42/35; 42/37; 42/39

(58) Field of Classification Search
CPC ..... F41A 9/65; F41A 9/47; F41A 9/70; F41A 9/72; F41A 9/75; F41A 9/37; F41A 9/68; F41A 9/83; F41A 17/38; F41A 17/46; F41A 19/34; F41A 3/38; F41A 5/12; F41A 5/18; F41A 9/12; F41A 9/19; F41A 9/62; F41A 9/63; F41A 9/66; F41A 9/06
USPC ..... 42/11, 17, 24, 29, 33, 35, 37, 39, 49.01
See application file for complete search history.

(56) References Cited

U.S. PATENT DOCUMENTS

| | | | | |
|---|---|---|---|---|
| 1,462,169 | A * | 7/1923 | Lewis | 42/17 |
| 2,066,361 | A * | 1/1937 | Nomar | 42/49.01 |
| 2,353,601 | A * | 7/1944 | Tisdale, Sr. | 89/126 |
| 2,509,553 | A | 5/1950 | Wylie | |
| 2,805,507 | A | 9/1957 | Buquor | |
| 3,722,125 | A | 3/1973 | Switzer | |
| 4,357,888 | A * | 11/1982 | Phillips et al. | 114/20.1 |
| 4,697,368 | A | 10/1987 | Williams | |
| 4,995,179 | A * | 2/1991 | Switzer | 42/50 |
| 5,024,139 | A * | 6/1991 | Knight et al. | 89/154 |

(Continued)

OTHER PUBLICATIONS

Liberator Pistol FP-45, The 90th Division Association [online], Jul. 1, 2003 [retrieved on Sep. 10, 2012]. Retrieved from the Internet: <URL: www.90thdivisionassoc.org/90thdivisionfolders/mainpages/liberator.htm>.

(Continued)

*Primary Examiner* — Samir Abdosh
(74) *Attorney, Agent, or Firm* — CreatiVenture Law, LLC; Dennis JM Donahue, III

(57) ABSTRACT

An ammunition compartment is located in the grip of a firearm's handle. The handle has a hinged door that opens to the compartment. The ammunition is mounted on a strip clip which slides into grooves in the inner walls of the compartment. The strip clip has a tab which extends outside the compartment when the door is open so that the ammunition can be quickly pulled from the compartment to load the firearm.

20 Claims, 3 Drawing Sheets

(56) References Cited

U.S. PATENT DOCUMENTS

| | | | | |
|---|---|---|---|---|
| 5,081,778 | A * | 1/1992 | Switzer | 42/50 |
| 5,113,604 | A * | 5/1992 | Vyprachticky | 42/50 |
| 5,519,953 | A * | 5/1996 | Villani | 42/1.02 |
| 6,094,850 | A * | 8/2000 | Villani | 42/1.02 |
| 6,854,205 | B2 | 2/2005 | Wikle | |
| 7,533,483 | B1 * | 5/2009 | Alzamora et al. | 42/50 |
| 2008/0190003 | A1 * | 8/2008 | Bolen | 42/50 |
| 2010/0139144 | A1 | 6/2010 | Fitzpatrick | |
| 2011/0078936 | A1 * | 4/2011 | Gates | 42/1.02 |

OTHER PUBLICATIONS

FP-45 Liberator Storage Compartment, Vintage Ordnance Company, LLC [online], 2008-2011 [retrieved on Sep. 10, 2012]. Retrieved from the Internet: <URL: http://vintageordnance.homestead.com/Liberator_Storage_Grip_.html>.

* cited by examiner

AMMUNITION COMPARTMENT WITH STRIP CLIP

CROSS-REFERENCE TO RELATED APPLICATIONS

This application claims priority from U.S. Provisional Patent Application No. 61/535,315 filed on Sep. 15, 2011.

STATEMENT REGARDING FEDERALLY SPONSORED RESEARCH

Not Applicable.

APPENDIX

Not Applicable.

BACKGROUND OF THE INVENTION

1. Field of Invention

The present invention relates to hand grips for guns, and more particularly to hand grips with compartments.

2. Related Art

Hand grips for guns have been known to include compartments for items, such as ammunition, batteries, cleaning tools, knife blades and other gear and equipment that may be used with a firearm or apart from the firearm. Some compartments are specially formed for ammunition, having individual holes for each round such as in U.S. Pat. No. 2,509,553. Other compartments can be attached to the handle of the firearm but are separate from the handle and are not located within the handle itself such as in U.S. Pat. No. 4,697,368 which has a cartridge holder secured within a separate storage compartment that is secured to the butt of a firearm. Other compartments are merely cavities formed within the hand grip without any internal structure to secure the cartridges within the cavity, such as in U.S. Pat. No. 2,805,507 which indicates that an inwardly facing blade separates two rows of cartridges but it does not secure the cartridges within the internal cavity.

There remains a need for a storage compartment that is formed as a cavity within the handle of a firearm and which securely stores the rounds of ammunition.

BRIEF DESCRIPTION OF THE DRAWINGS

The present invention will become more fully understood from the detailed description and the accompanying drawings.

DETAILED DESCRIPTION OF THE PREFERRED EMBODIMENTS

The following description of the preferred embodiment(s) is merely exemplary in nature and is in no way intended to limit the invention, its application, or uses.

Figure 1:
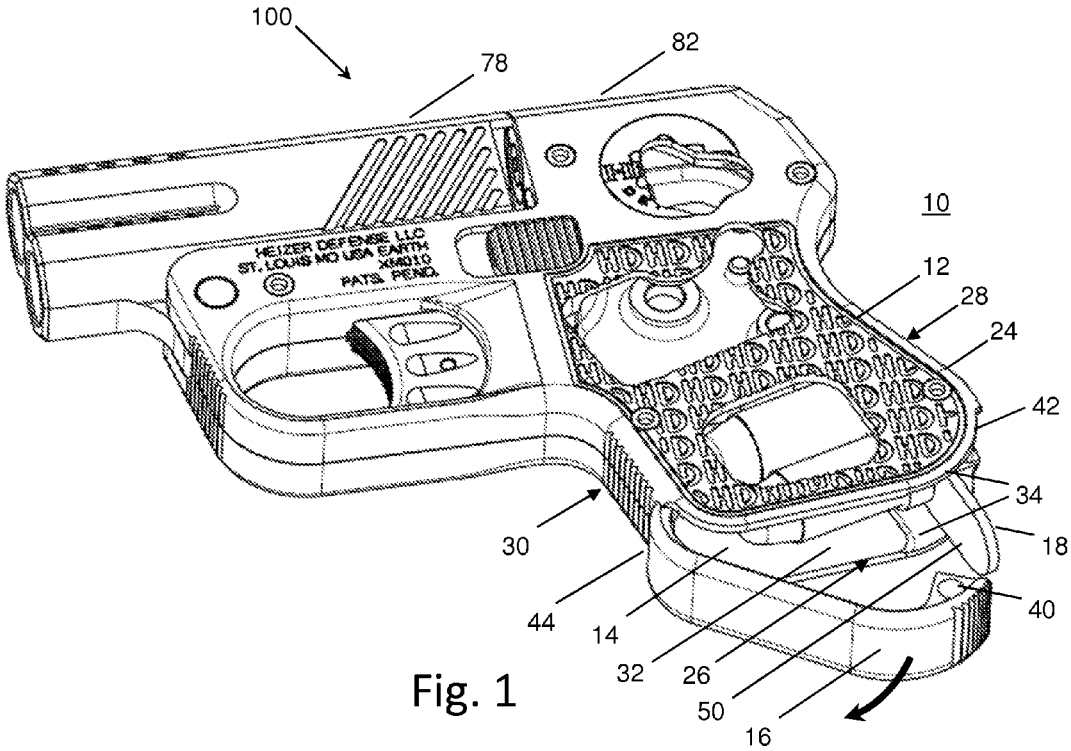
FIG. 1 is a perspective view of a firearm with a partial cutaway of the grip.

The present invention relates to the handle 10 of a firearm 100. The handle 10 has an outer grip 12, an inner compartment 14 and a door 16 fitted therebetween. An ammunition strip clip 18 slides into one end of the inner compartment 14 and securely holds cartridges 20 within the compartment. FIG. 1 shows a perspective view of the firearm 100 with a partial cutaway of the grip 12 which reveals the ammunition 20 mounted on the strip clip 18 within the storage compartment 14.

The outer grip 12 portion of the handle 10 has a pair of opposing side walls 22, an end wall 24 between the side walls 22, and an open section 26 that is between the side walls 22 and is adjacent to the end wall 24. In the preferred embodiment, the end wall 24 is located at the palm side 28 of the grip 12 at one side of the open section 26*a*. The finger side 30 of the grip 12 is at an opposite side of the open section 26*b*.

Figure 2:
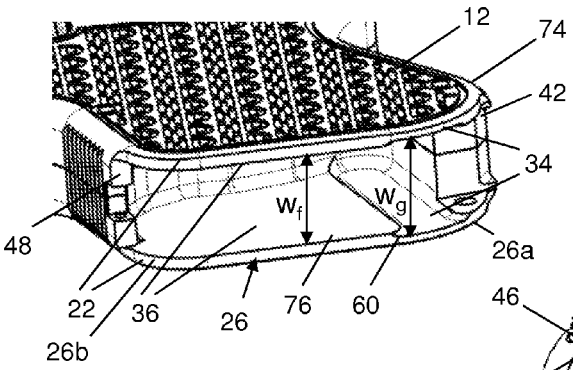
FIG. 2 is an interior view of the grip.

The ammunition storage compartment 14 has a cavity 32 and a pair of opposing grooves 34. The cavity 32, shown in FIG. 2 with the door removed and empty (i.e., without the strip clip 18 or ammunition 20), is situated between the side walls 22 and the end wall 24. The grooves 34 are formed in opposing inner faces 36 of the side walls 22. The grooves extend from the open section 26 into the cavity 32. The compartment width as measured between the grooves ($w_g$) is wider than the compartment width as measured between the between the faces without grooves ($w_f$). As described in more detail below, the grooves 34 help secure the ammunition 20 within the cavity 32 by holding the strip clip 18 in place, and the strip clip 18 holds the cartridges 20. The inner compartment 14 has an inner wall 38 extending into the cavity 32 from the open section 26, and the grooves 34 extend into the cavity along the inner wall. In the preferred embodiment, the inner wall 38 is the interior side of the end wall 24.

Figure 3:
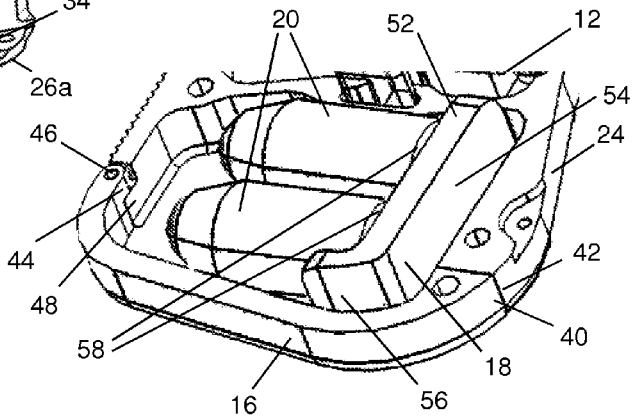
FIG. 3 is a cutaway perspective view of the grip.

The door 16 has an open position as shown in FIG. 1 (partially open) and a closed position as shown in FIG. 3. In the open position, one end of the door 16*a* is swung away from the open section 26, and in the closed position, the door covers the open section 26. The distal end 16*a* of the door has a latch 40 that engages a catch 42 in the end wall 24 of the grip 12. The proximate end 16*b* of the door has a hinge bracket 44 and a hinge pin 46 that engage a hinge mount 48 on the grip 12 at the finger side of the open section 26*b*.

As indicated above, the strip clip 18 securely holds the cartridges 20 in the cavity 32 of the ammunition compartment 14 within the grip 12 of the firearm's handle 10. In addition to holding the ammunition in place, the strip clip 18 cushions the primer end of the rounds 20 against the end wall 24. The strip clip 18 has a base 50, a pair of side edges 52, a bottom face 54 and a tab 56. The base 50 has cartridge mounts 58 which are used to secure the ammunition 20 to the strip clip 18. The strip clip 18 is wider than the compartment width ($w_f$) and is approximately as wide as the width between the grooves ($w_g$) so that the side edges 52 securely and slidingly fit into the grooves 34 with the bottom face 54 situated next to the inner wall 38. The tab 56 is preferably formed of a resilient material and extends out of the open section 26 when the door 16 is open and bends within the cavity 32 when the door is closed.

The grooves 34 preferably include a flared segment 60 proximate to the open section 26 so that the tab 56 is held between the flared segment and the door 16 when the door is closed. Also, when the door 16 is closed, the tab 56 bends around the shell 62 of the cartridge that is adjacent to the door. The diameter of the shell 62 is narrower than the width of the strip clip 18 and is approximately as wide as the compartment width ($w_f$), and the wrapping of the tab 56 around the shell 62 provides additional cushioning to the cartridge 20 that is situated next to the door 16.

Figure 4A:
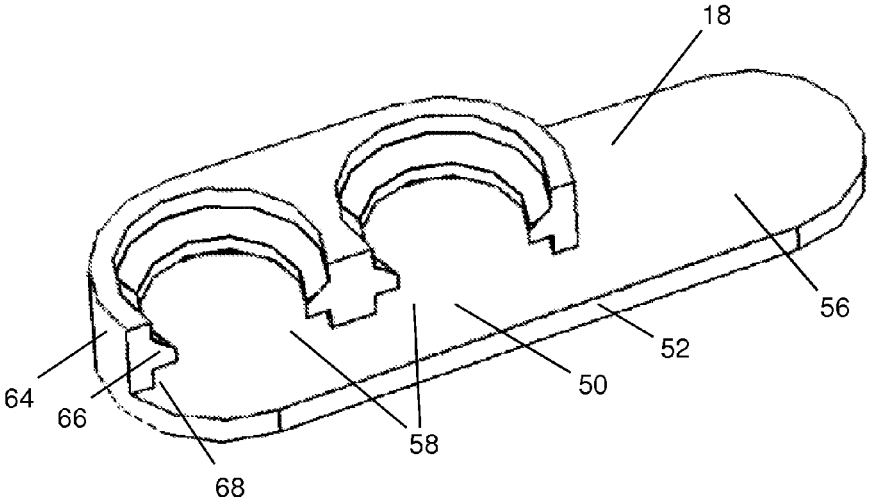
FIGS. 4A-4D are views of a strip clip that is used to hold the cartridges.
Figure 4D:
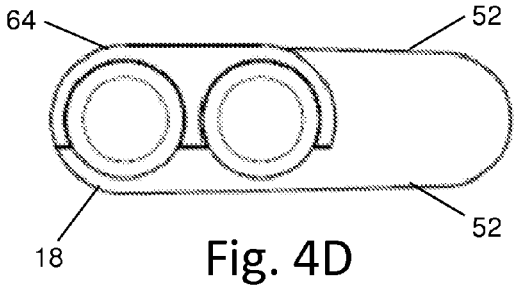
Figure 4B:
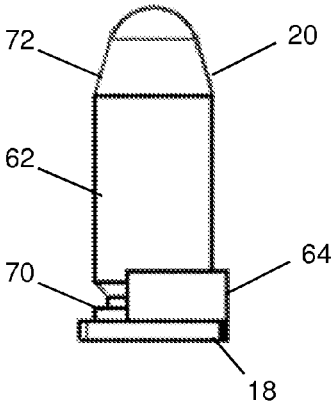
Figure 4C:
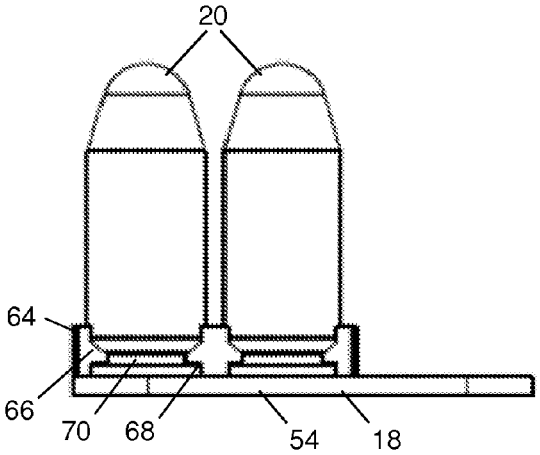
Figure 4E:
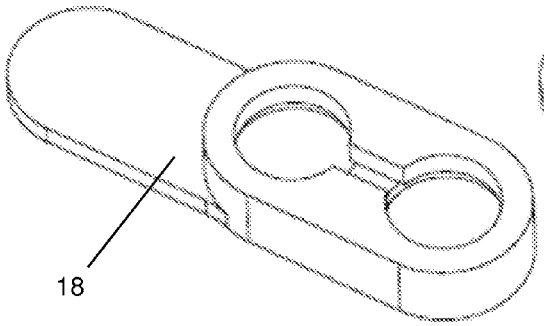
Figure 4F:
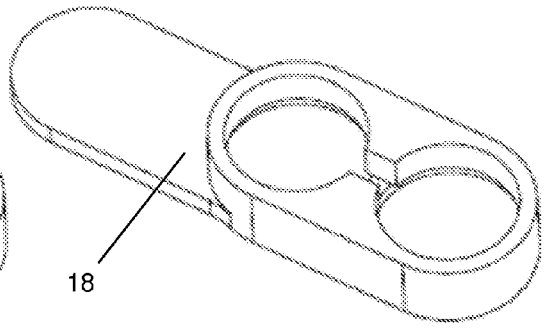

A first embodiment of the strip clip 18 is shown in FIGS. 4A-D and a second embodiment of the strip clip is shown in FIGS. 4E and 4F. In the first embodiment, the cartridge mounts 58 have a semicircular wall 64 and a flange 66. The flange 66 extends inwardly along the inner surface 68 of the semicircular wall 62 and fits within the rims 70 of the cartridges 20. The semicircular cartridge mounts are arranged adjacent to each other with their walls 64 extending from the base 50 of the strip clip 18. The flange 66 is located between the base 50 and the top of the walls. The flanges form semicircular ridges at the base of the strip clip and the rims of the cartridge fits snugly within this ridge space. It will be appreciated that while the particular speed loader shown in the illustrations is for a design with two shells in a row, other configurations are possible, including configurations which hold more than two shells.

As indicated above, the strip clip 18 is slid into the groove within the compartment 14 so that the tab 56 extends out of the open section 26 when the door is open, and the cartridges 20 are also slid into the cavity with the side of the rounds having the bullet 72 facing away from the end wall 24. It will be appreciated that other strip clip designs could also be used, including the standard design for strip clips 18 in which the cartridge mounts 58 encircle almost the entire base of the shell with a slit between the mounts. The standard design is shown in the second embodiment for different caliber rounds, with a 9 mm cartridge shown in FIG. 4E and a 45 ACP cartridge shown in FIG. 4F. The outer dimensions of the strip clips 18 are the same so that they both securely fit within the compartment 14 while holding their respective caliber rounds. The width of the tabs 56 for these strip clips 18 is slightly narrower than the width of the base 50.

In the preferred embodiment, the open section 26 and the door 16 are located at the butt 74 of the handle 10, and the grooves extend into the handle from the open section so the strip clip 18 slides into the grooves 34. It will also be appreciated that, depending on the depth of the cavity 32 and the calibers of ammunition to be stored in the compartment 14, the grooves 34 could be machined along the edge 76 of the open section 26 so that the strip clip 18 may have a snap-fit engagement or other type of secure fitting with the grooves. Also, while the strip clip 18 is preferably made from a resilient material, more rigid materials could be used, and rather than having a resilient tab that unfolds to extend from the handle, the strip clip could have a notch or a lip that is used for pulling the strip clip out from the cavity or the strip clip may have a hinged tab. These variations in design are within the overall scope of the present invention.

Figure 5:
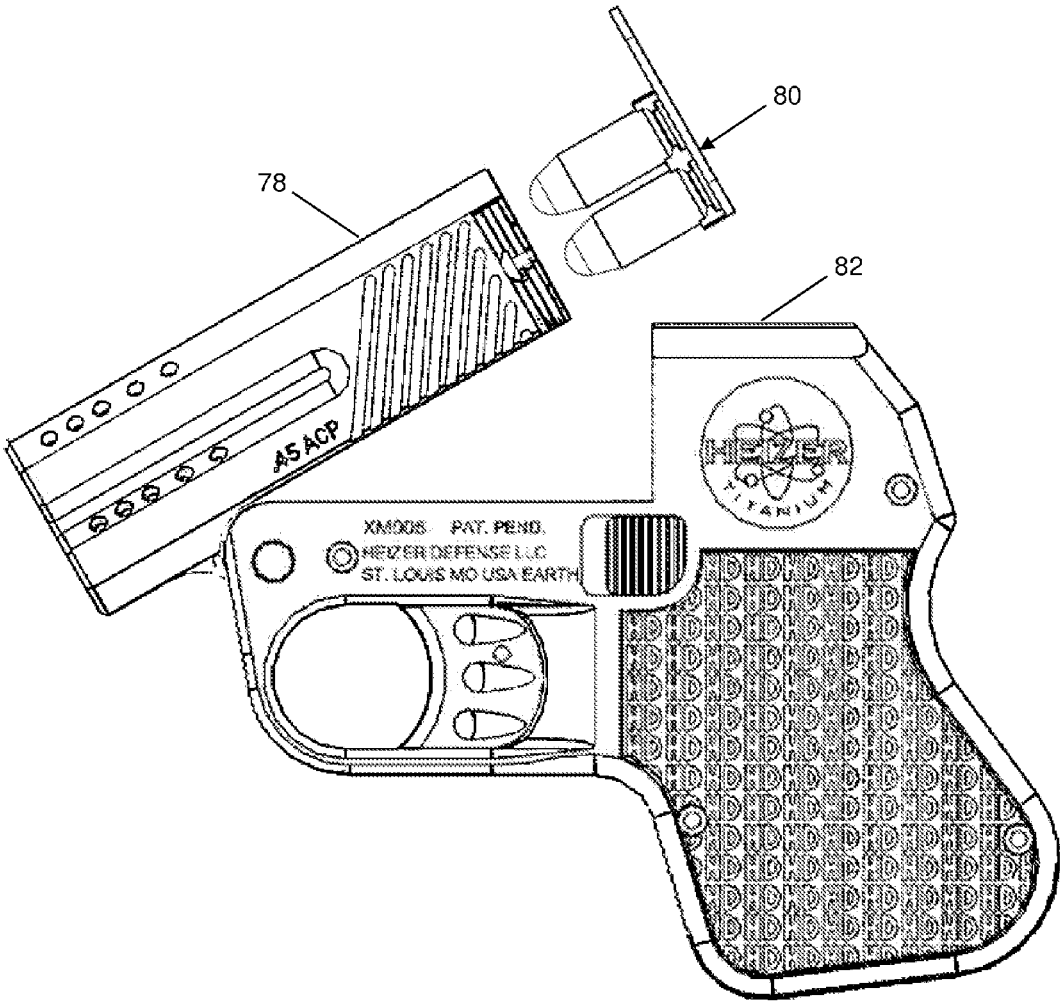
FIG. 5 is a side view of the firearm with an open barrel for loading cartridges.

An exemplary use of the ammunition storage compartment 14 is illustrated in FIG. 5. After the pistol 100 is fired, the empty shells are ejected from the barrel 78 or other chambers for the shells, and the latch 40 on the door 16 of the handle 10 is released to permit access to the spare ammunition 20 in the compartment 14. The strip clip 18 can serve as a speed loader 80 because the ammunition 20 can be pulled from the compartment 14 and loaded into the barrels 78 without being removed from the strip clip. As indicated above, the resilient tab 56 unfolds and protrudes from the bottom of the handle 10 when the door 16 is released and opened. The shooter pulls the tab 56 to extract the speed loader 80 with the cartridges 20 attached to the strip clip 20 and loads the firearm while the strip clip 18 is still attached to the cartridge shells. Once the cartridges are loaded in the gun, the speed loader is pulled away leaving the cartridges in their firing-ready position. For the particular firearm design shown in FIG. 5, the cartridges 20 are loaded into the barrel 78, and the firearm is ready to fire when the loaded double-barrel is closed on the firearm frame 82.

By securing the strip clip 18 within the grooves 34 in the compartment 14, different calibers of ammunition can be stored within the same cavity, such as described above with reference to the strip clips shown in FIGS. 4E and 4F. This can be helpful for a firearm with a frame 82 that can accommodate different caliber rounds 20. For example, in the particular embodiment in which the ammunition 20 is directly loaded into the barrel 78, different caliber barrels 78 can be mounted onto the frame 82, and the same compartment can be used for the different caliber ammunition 20 that correspond with the caliber of the barrels 78.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. For example, although the preferred embodiment positions the open section of the grip and the door at the butt end of the handle it will also be appreciated that the open section and door could be at the palm side of the handle or the finger side of the handle without departing from the scope of the present invention. Thus, the breadth and scope of the present invention should not be limited by any of the above-described exemplary embodiments, but should be defined only in accordance with the following claims appended hereto and their equivalents.

What is claimed is:

1. A handle for a firearm, comprising:

an outer grip portion comprising a pair of opposing side walls, at least one end wall between said side walls, and an open section between said side walls and adjacent to said end wall;

an inner compartment comprising a cavity, an inner wall and a first groove, wherein said cavity is situated between said side walls and said end wall, wherein said first groove is formed in an inner face of at least one of said side walls and extends from said open section into said cavity along said inner wall for a distance, wherein said cavity has a first width between said side walls, wherein said first groove produces a second width between said side walls greater than said first width, and wherein said distance said groove extends from said open section into said cavity is at least as long as said first width; and a door fitted between said open section of said outer grip portion and said cavity.

2. The invention of claim 1, wherein said outer grip portion further comprises a hinge mount, and wherein said door further comprises a hinge bracket and a hinge pin operatively engaging with said hinge mount.

3. The invention of claim 2, wherein said end wall further comprises a catch, and wherein said door further comprises a latch at a distal end away from said hinge bracket, said latch engaging said catch to secure said door in a closed position over said open section.

4. The invention of claim 3, wherein said open section and said door are located at a butt section of said outer grip portion.

5. The invention of claim 1 further comprising a strip clip comprising a base, a side edge, a bottom face and a tab, wherein said base comprises a plurality of cartridge mounts, wherein said strip clip is wider than said first width and is approximately as wide as said second width,wherein said side edge slidingly fits into said groove, wherein said bottom face is situated proximate to said inner wall, and wherein said tab extends from said base toward said open section.

6. The invention of claim 5 further comprising a plurality of cartridges located in said cavity and secured to said strip clip through said cartridge mounts.

7. The invention of claim 6, wherein said tab is formed of a resilient material and bends around a shell of one of said cartridges when said door is closed over said open section and extends out of said open section when said door is swung away from said open section.

8. The invention of claim 6, wherein each of said cartridge mounts is comprised of a semicircular wall and a flange, and wherein said flange extends inwardly along an inner surface of said semicircular wall and fits within a rim of said cartridges.

9. The invention of claim 1, wherein said first groove is further comprised of a flared segment proximate to said open section.

10. The invention of claim 1 further comprising a second groove directly opposite from said, first groove, wherein said first groove and said second groove are formed in opposing faces of said side walls.

11. A handle for a firearm, comprising:

an outer grip portion comprising a pair of opposing side walls, at least one end wall between said side walls, and an open section between said side walls and adjacent to said end wall;

an inner compartment comprising a cavity and a pair of opposing grooves, wherein said cavity is situated between said side walls and said end wall, wherein said grooves are formed in opposing inner faces of said side walls and extend from said open section into said cavity, wherein said cavity has a first width between said inner faces of said side walls, and wherein said grooves produce a second width between said inner faces greater than said first width;

a strip clip comprising a base, a pair of side edges, a bottom face and a tab, wherein said base comprises a plurality of cartridge mounts, wherein said strip clip is wider than said first width and is approximately as wide as said second width, wherein said side edges securely fit into said grooves, wherein said bottom face is situated proximate to said inner wall, and wherein said tab extends from said base toward said open section; and a door fitted between said inner compartment and said open section of said outer grip portion.

12. The invention of claim 11, wherein each of said grooves has a flared segment proximate to said open section, and wherein said grooves extend from said open section into said cavity a distance at least as long as said first width.

13. The invention of claim 12, wherein said tab is formed of a resilient material and extends out of said open section when said door is swung away from said open section and bends within said cavity between said flared segment of said grooves and said door when said door is closed over said open section.

14. The invention of claim 11, wherein said outer grip portion further comprises a catch at said end wall at one end of said open section and a hinge mount at an opposite end of said open section, wherein said door further comprises a hinge bracket, a hinge pin and a latch, wherein said hinge bracket and said hinge pin operatively engage said hinge mount, and wherein said latch engages said catch to secure said door in a closed position over said open section.

15. The invention of claim 11, wherein said inner compartment further comprises an inner wall extending into said cavity from said open section, wherein said grooves extend into said cavity along said inner wall, and wherein said strip clip has a sliding engagement with said grooves.

16. The invention of claim 11 further comprising a plurality of cartridges located in said cavity and secured to said strip clip through said cartridge mounts.

17. The invention of claim 16, wherein each of said cartridges have a bullet and a shell with a rim, wherein said shell is approximately as wide as said first width.

18. A handle for a firearm, comprising:

an outer grip portion comprising a pair of opposing side walls, at least one end wall between said side walls, and an open section between said side walls and adjacent to said end wall;

an inner compartment comprising a cavity and a pair of opposing grooves, wherein said cavity is situated between said side walls and said end wall, wherein said grooves are formed in opposing inner faces of said side walls and extend from said open section into said cavity, wherein said cavity has a first width between said inner faces of said side walls, wherein said grooves produce a second width between said inner faces greater than said first width, and wherein each of said grooves has a flared segment proximate to said open section;

a door fitted between said inner compartment and said open section of said outer grip portion, wherein said door has an open position with at least one end of said door swung away from said open section and a closed position with said door covering said open section; and a strip clip comprising a base, a pair of side edges, a bottom face and a tab, wherein said base comprises a plurality of cartridge mounts, wherein said strip clip is wider than said first width and is approximately as wide as said second width, wherein said side edges slidingly fit into said grooves, wherein said bottom face is situated proximate to said inner wall, wherein said tab is formed of a resilient material and extends out of said open section when said door is in said open position and bends within said cavity between said flared segment of said grooves and said door when said door is in said closed position.

19. The invention of claim 18 further comprising a plurality of cartridges located in said cavity and secured to said strip clip through said cartridge mounts, wherein each of said cartridges have a bullet and a shell with a rim, wherein said shell is approximately as wide as said first width.

20. The invention of claim 19, wherein said inner compartment further comprises an inner wall extending into said cavity from said open section, wherein said grooves extend into said cavity along said inner wall a distance, wherein said tab bends around said shell of one of said cartridges adjacent to said door when said door is in said closed position and wherein said distance said grooves extend from said open section into said cavity is at least as long as said first width.

* * * * *